US008369695B2

(12) United States Patent
Lee et al.

(10) Patent No.: US 8,369,695 B2
(45) Date of Patent: Feb. 5, 2013

(54) STEAM GENERATOR OF STEAM OVEN

(75) Inventors: Yong-woo Lee, Gwangmyeong-si (KR); Jae-kyung Yang, Seoul (KR); Yang-kyeong Kim, Bucheon-si (KR); Sung-il Park, Anyang-si (KR)

(73) Assignee: LG Electronics Inc., Seoul (KR)

( * ) Notice: Subject to any disclaimer, the term of this patent is extended or adjusted under 35 U.S.C. 154(b) by 745 days.

(21) Appl. No.: 12/521,226

(22) PCT Filed: Nov. 5, 2007

(86) PCT No.: PCT/KR2007/005543

§ 371 (c)(1), (2), (4) Date: Nov. 13, 2009

(87) PCT Pub. No.: WO2008/082070

PCT Pub. Date: Jul. 10, 2008

(65) Prior Publication Data

US 2010/0054717 A1 Mar. 4, 2010

(30) Foreign Application Priority Data

Dec. 29, 2006 (KR) ..... 10-2006-0137918

(51) Int. Cl.
*F24H 1/18* (2006.01)

(52) U.S. Cl. ..... 392/401; 392/386; 392/394; 392/399

(58) Field of Classification Search ..... 392/386, 392/394, 399, 401
See application file for complete search history.

(56) References Cited

U.S. PATENT DOCUMENTS 4,367,724 A * 1/1983 Willett ..... 126/20
4,810,856 A * 3/1989 Jovanovic ..... 219/401
5,515,773 A * 5/1996 Bullard ..... 99/330
5,680,810 A * 10/1997 Sham ..... 99/330
6,100,502 A * 8/2000 Sham et al. ..... 219/401
6,321,035 B1 * 11/2001 Gerosa ..... 392/399
6,947,664 B1 * 9/2005 Yeh ..... 392/405
6,972,397 B2 * 12/2005 Ha ..... 219/401
7,091,454 B2 * 8/2006 Cho et al. ..... 219/401

(Continued)

FOREIGN PATENT DOCUMENTS

JP 9-101034 4/1997
JP 2004-340482 12/2004

(Continued)

OTHER PUBLICATIONS

International Search Report dated Jan. 29, 2008.

*Primary Examiner* — Thor Campbell
(74) *Attorney, Agent, or Firm* — KED & Associates LLP

(57) ABSTRACT

Disclosed is a steam oven to cook food in a cooking chamber by use of steam. More particularly, disclosed is a steam generator of a steam oven, which can simplify the configuration of a device required to generate steam and is detachably attached to a cabinet to assure easy cleaning and washing thereof. The steam generator includes a single body having an inner space divided into a water supply compartment and a boiler compartment by a partition, the water supply compartment having a water pouring hole, and the boiler compartment having a heater and a steam discharge hole. Also, a water supply passage is defined between the water supply compartment and the boiler compartment. This configuration has the effects of achieving improved workability and reduced manufacturing costs of the steam generator and also, of overcoming a limit in the inner volume of a cooking chamber of the steam oven.

10 Claims, 12 Drawing Sheets

U.S. PATENT DOCUMENTS

| | | | | |
|---|---|---|---|---|
| 7,123,824 | B2 * | 10/2006 | Altman et al. | 392/459 |
| 7,304,271 | B2 * | 12/2007 | Cho et al. | 219/401 |
| 7,304,278 | B2 * | 12/2007 | Kanzaki et al. | 219/682 |
| 7,537,004 | B2 * | 5/2009 | Reay | 126/369 |
| 7,623,771 | B2 * | 11/2009 | Lentz et al. | 392/386 |
| 7,726,234 | B2 * | 6/2010 | Glier | 99/348 |
| 7,743,697 | B2 * | 6/2010 | Cutrer, Jr. | 99/339 |
| 7,756,404 | B2 * | 7/2010 | Schubert et al. | 392/478 |
| 7,867,534 | B2 * | 1/2011 | Sells et al. | 426/233 |
| 8,019,208 | B2 * | 9/2011 | Altman et al. | 392/485 |
| 2005/0051530 | A1 * | 3/2005 | Shozo | 219/401 |
| 2005/0115559 | A1 * | 6/2005 | Hwang | 126/369 |
| 2006/0096970 | A1 * | 5/2006 | Yang et al. | 219/401 |
| 2006/0107943 | A1 * | 5/2006 | Saksena | 126/348 |
| 2006/0278630 | A1 * | 12/2006 | Sung et al. | 219/401 |
| 2007/0210058 | A1 * | 9/2007 | Ando et al. | 219/401 |
| 2007/0215595 | A1 * | 9/2007 | Wang | 219/401 |
| 2008/0017629 | A1 * | 1/2008 | Xu et al. | 219/401 |
| 2008/0229936 | A1 * | 9/2008 | Kaneko et al. | 99/357 |
| 2009/0007798 | A1 * | 1/2009 | Yamaguchi et al. | 99/330 |
| 2009/0250452 | A1 * | 10/2009 | Tse | 219/401 |

FOREIGN PATENT DOCUMENTS

| | | |
|---|---|---|
| JP | 2005-155998 | 6/2005 |
| KR | 20-0206804 | 10/2000 |
| KR | 10-2005-0068482 | 7/2005 |
| KR | 10-2006-0132211 | 12/2006 |

* cited by examiner

STEAM GENERATOR OF STEAM OVEN

BACKGROUND OF THE INVENTION

1. Field of the Invention

The present invention relates to a steam oven to cook food in a cooking chamber by use of steam, and more particularly, to a steam generator of a steam oven, which can simplify the configuration of a device required to generate steam and is detachably attached to a cabinet to assure easy cleaning and washing thereof.

2. Description of the Related Art

FIG. 1 is a perspective view illustrating the overall configuration of a conventional steam oven. The steam oven includes a cabinet 110 defining a cooking chamber 111 therein, a door 112 to open or close the cooking chamber 111, and a control panel 113 provided at an upper location of a front surface of the cabinet 110, the control panel 113 having a variety of operating switches and a display to provide information.

The steam oven further includes a steam generating device received in the cooking chamber 111. The steam generating device includes a water injector 114 installed at the control panel 113 to extend from the control panel 113 into the cabinet 110, a boiler 115 mounted in the bottom of the cooking chamber 111 and used to generate vapor, and a water supply pipe 116 to connect the water injector 114 and the boiler 115 to each other.

The boiler 115, as shown in FIG. 2, includes a water tank 117 serving as a steam container to store water therein, and a heater 117*a* to heat the water stored in the water tank 117. A convection heater 118 and a convection fan 119 are mounted in the rear wall of the cooking chamber 111, to heat and circulate air inside the cooking chamber 111.

In the steam oven having the above described configuration, water is supplied from the water injector 114 into the water tank 117 of the boiler 115 through the water supply pipe 116. Then, the water in the water tank 117 is heated by the heater 117*a*, to generate steam. The generated steam is used to cook food while being circulated in the cooking chamber 111 by operation of the convection fan 119.

The steam generating device of the conventional steam oven has a complicated configuration in such a manner that the water injector is separately provided to supply water into the water tank of the boiler, the water injector and the water tank of the boiler are connected to each other by means of the water supply pipe, the heater is installed in the water tank of the boiler to heat water in the water tank so as to generate steam, the convection fan is mounted in the cooking chamber to circulate the steam in the cooking chamber, and the convection heater is provided to heat the interior air of the cooking chamber.

The complicated configuration of the steam generating device causes not only a degradation in workability, but also increased manufacturing costs, and inevitably has a limit in the size of an inner space of the cooking chamber.

Moreover, the above described configuration of the steam generating device exhibits a complex coupling relationship of assembling elements, which makes it difficult for a consumer to disassemble the steam generating device by oneself. Therefore, the steam generating device has a difficulty in cleaning and washing. Also, when using the steam generating device for a long time, minerals (calcareous) contained in water are precipitated as scale, providing the steam generator with poor heating performance and unsanitary condition.

SUMMARY OF THE INVENTION

Therefore, the present invention has been made in view of the above problems, and it is an object of the present invention to provide a steam generator of a steam oven, which can simplify the configuration of a device required to generate steam, and is detachably attached to a cabinet to assure easy cleaning and washing thereof.

It is another object of the present invention to provide a steam generator of a steam oven, which can more efficiently and rapidly generate steam by an improved water heating manner using a heater.

It is yet another object of the present invention to provide a steam generator of a steam oven, which can allow a steam discharge hole thereof to be automatically opened or closed when the steam generator is attached to or detached from a cabinet of the steam oven.

In accordance with the present invention, the above and other objects can be accomplished by the provision of a steam generator of a steam oven to cook food received in a cooking chamber by use of steam generated by the steam generator, wherein the steam generator comprises a single body having an inner space divided into a water supply compartment and a boiler compartment by a partition, the water supply compartment having a water pouring hole, and the boiler compartment having a heater and a steam discharge hole, and wherein a water supply passage is defined between the water supply compartment and the boiler compartment.

The water pouring hole and the steam discharge hole may be located at one side and the other side of the upper part of the upright body, and a steam passage may be defined between the steam discharge hole and the boiler compartment. The water supply passage may be defined by a water-level adjusting hole having a barrier wall extending from the partition into the boiler compartment.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
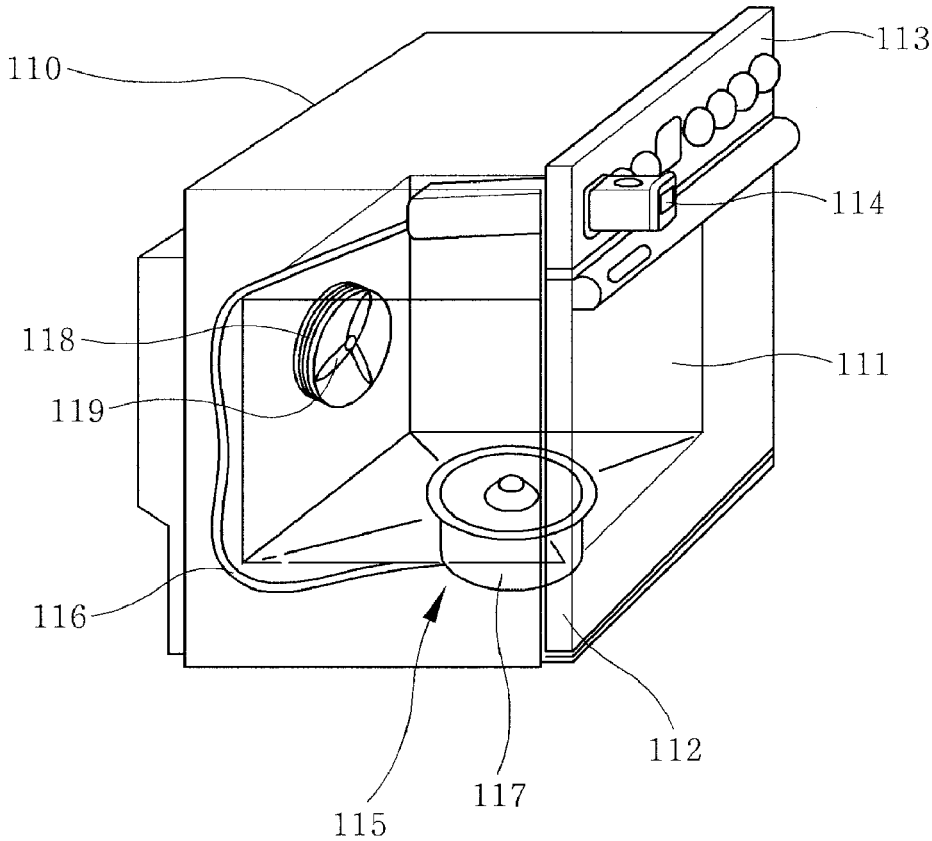
FIG. 1 is a perspective view illustrating the overall configuration of a conventional steam oven.
Figure 2:
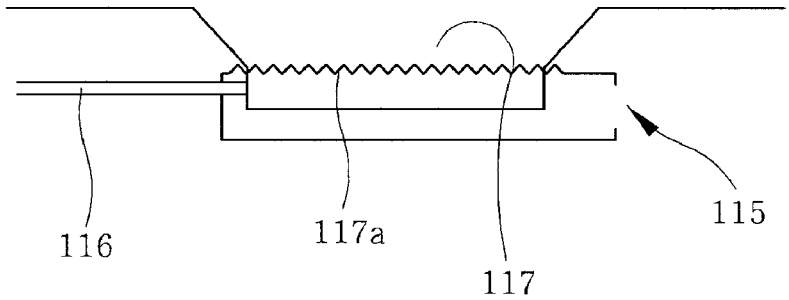
FIG. 2 is an enlarged sectional view of a boiler shown in FIG. 1.

Now, preferred embodiments of the present invention will be described in detail with reference to the accompanying drawings. In the following description, some parts substantially the same as those in the previously described prior art will be denoted by the same reference numerals.

Figure 3:
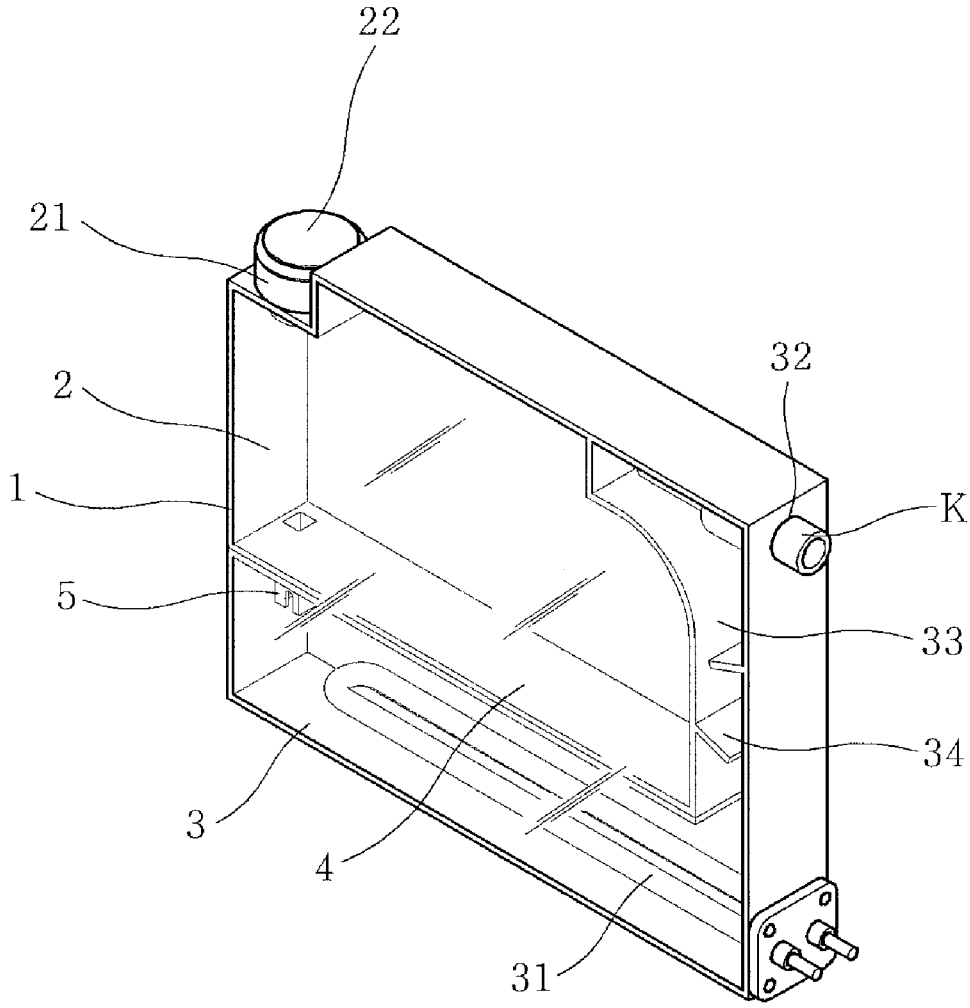
FIGS. 3 to 10 illustrate a steam generator according to a first embodiment of the present invention, FIG. 3 being a perspective view illustrating the overall configuration of the steam generator, FIG. 4 being a longitudinal sectional view of FIG. 3, FIG. 5 being an enlarged sectional view of the portion "B" in FIG. 4, FIG. 6 being a perspective view illustrating an opening/closing unit for a steam discharge hole of the steam generator, FIGS. 7 and 8 being sectional views illustrating the operation of the opening/closing unit shown in FIG. 6, FIG. 9 being a perspective view illustrating the overall configuration of a cabinet of the steam oven, and FIG. 10 being a partially cut-away enlarged perspective view of a fixing bracket, which is used to fix the steam generator to the cabinet.
Figure 4:
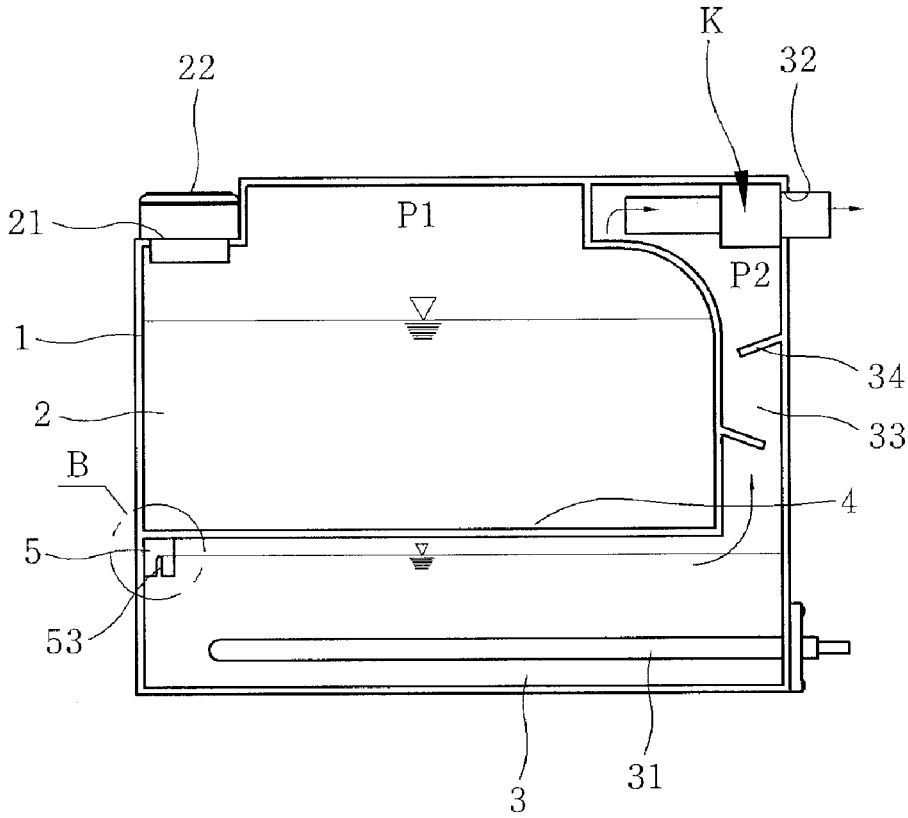
Figure 5:
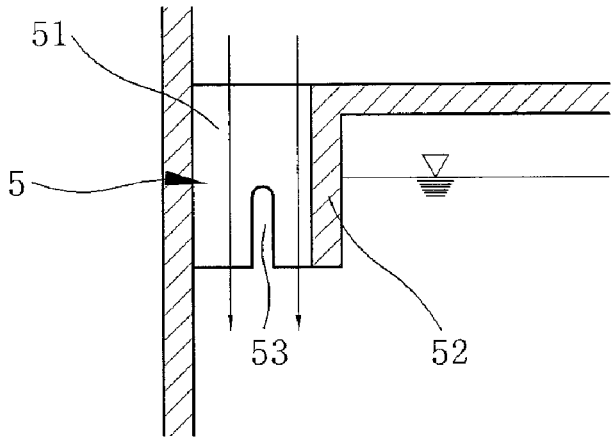

FIGS. 3 to 10 illustrate a steam generator according to a first embodiment of the present invention. More particularly, FIG. 3 is a perspective view illustrating the overall configuration of the steam generator, FIG. 4 is a longitudinal sectional view of FIG. 3, and FIG. 5 is an enlarged sectional view of the portion "B" in FIG. 4.

As shown, the steam generator according to the present invention includes a rectangular upright body 1 having a water pouring hole 21 and a steam discharge hole 32. The inner space of the upright body 1 is divided into upper and lower compartments by a partition 4, the upper compartment serving as a water supply compartment 2 and the lower compartment serving as a boiler compartment 3. A water supply passage 5 is provided between the water supply compartment 2 and the boiler compartment 3, to allow water stored in the water supply compartment 2 to be introduced into the boiler compartment 3 through the water supply passage 5.

The water pouring hole 21 and the steam discharge hole 32 are located, respectively, at one side and the other side of the upper part of the upright body 1. A steam passage 33 is defined between the steam discharge hole 32 and the boiler compartment 3. A plurality of water-splash-proof partitions 34 are arranged alternately at both sidewalls of the steam passage 33 to face each other. Each water-splash-proof partition 34 has a downwardly-inclined surface 34*a*.

The water supply passage 5 is defined by a water-level adjusting hole 51 having a barrier wall 52 extending from the partition 4 into the boiler compartment 3. The barrier wall 52 has a bottom-opened slit 53.

The water pouring hole 21 can be opened or closed by a plug 22, and the steam discharge hole 32 can be opened or closed by a steam discharge hole opening/closing unit k. The steam discharge hole opening/closing unit k will be described later in detail.

The most important features of the present invention having the above described configuration are that the water supply compartment 2 and the boiler compartment 3 are defined in the single upright body 1 and that cold water in the water supply compartment 2 can be supplied into the boiler compartment 3 by a predetermined amount as much as a discharge amount of steam, without a risk of being mixed with hot water previously heated by a heater 31, to continuously keep the level of water in the boiler compartment 3 at a constant value.

The principal of continuously keeping the level of water in the boiler compartment 3 at a constant value is based on Torricelli's Experiment, which is devised and performed by E. Torricelli and represents the atmospheric pressure and the existence of vacuum. In Torricelli's Experiment, first, an elongated glass tube, which has a length of about 1 m and is closed at one end thereof, is filled up with mercury. Then, the glass tube is inverted while paying attention to close the other open end of the glass tube by the hand so as to prevent air from entering the glass tube. The inverted glass tube is put into and erected upright in a cistern of mercury such that the open end of the glass tube is immersed in mercury.

In such a state, the surface level of mercury column in the glass tube is lowered and stops at a predetermined height (about 760 mm). As can be understood from the above description, the atmosphere applies a pressure, which is equal to a pressure produced by a mercury column with a height of about 760 mm, into the glass tube. Here, a vacuum produced in the glass tube at the upper side of the mercury column is called "Torricelli's Vacuum".

Applying the above described Torricelli's Experiment to the present invention, the water supply compartment 2 corresponds to the glass tube, and the boiler compartment 3 corresponds to the cistern of mercury. Also, by the provision of the water-level adjusting hole 51 having the barrier wall 52 extending from the partition 4 into the boiler compartment 3, the water supply compartment 2 can be positioned as if it is inverted and erected upright in the boiler compartment 3. Thereby, the water in the water supply compartment 2 is affected by the atmospheric pressure, and consequently, the water in the boiler compartment 3 can be always kept at a constant level.

However, if all the water pouring hole 21 of the water supply compartment 2 and the steam discharge hole 32 of the boiler compartment 3 are opened, the interior of the water supply compartment 2 is changed from a vacuum state to an atmospheric pressure state, and it is impossible to adjust the level of water on the basis of Torricelli's Experiment.

In operation of the present invention having the above described configuration, first, the water in the boiler compartment 3 is heated by the heater 31 to generate steam, and the generated steam is discharged into a cooking chamber of the steam oven through the steam passage 33 and the steam discharge hole 32, so as to cook food received in the cooking chamber.

The water in the boiler compartment 3 will be reduced as much as the amount of steam discharged through the steam discharge hole 32. Accordingly, to continuously keep the level of water in the boiler compartment 3 at a constant value, supplementary water is supplied from the water supply compartment 2 into the boiler compartment 3 by an amount as much as the reduced amount of water.

As described above, the principal of continuously keeping the level of water in the boiler compartment 3 at a constant value is based on Torricelli's Experiment. If the level of water in the boiler compartment 3 reaches the height of the slit 53 formed in the barrier wall 52 of the water-level adjusting hole 51, the water in the water supply compartment 2 is supported by the atmospheric pressure acting on the water surface of the boiler compartment 3, and consequently, the level of water does not further rise and stops at the height of the slit 53.

Then, if the water in the boiler compartment 3 is changed into steam and discharged out of the boiler compartment 3, the amount of water in the boiler compartment 3 is reduced, and the water in the water supply compartment 2 cannot be further supported by the atmospheric pressure acting on the water surface of the boiler compartment 3. As a result, the water in the water supply compartment 2 is discharged into the boiler compartment 3. Thereafter, if the level of water in the boiler compartment 3 again reaches the height of the slit 53 formed in the barrier wall 52 of the water-level adjusting hole 51, the water in the water supply compartment 2 can be supported by the atmospheric pressure acting on the water surface of the boiler compartment 3, and the level of water in the boiler compartment 3 does not further rise and stops at the height of the slit 53.

Figure 6:
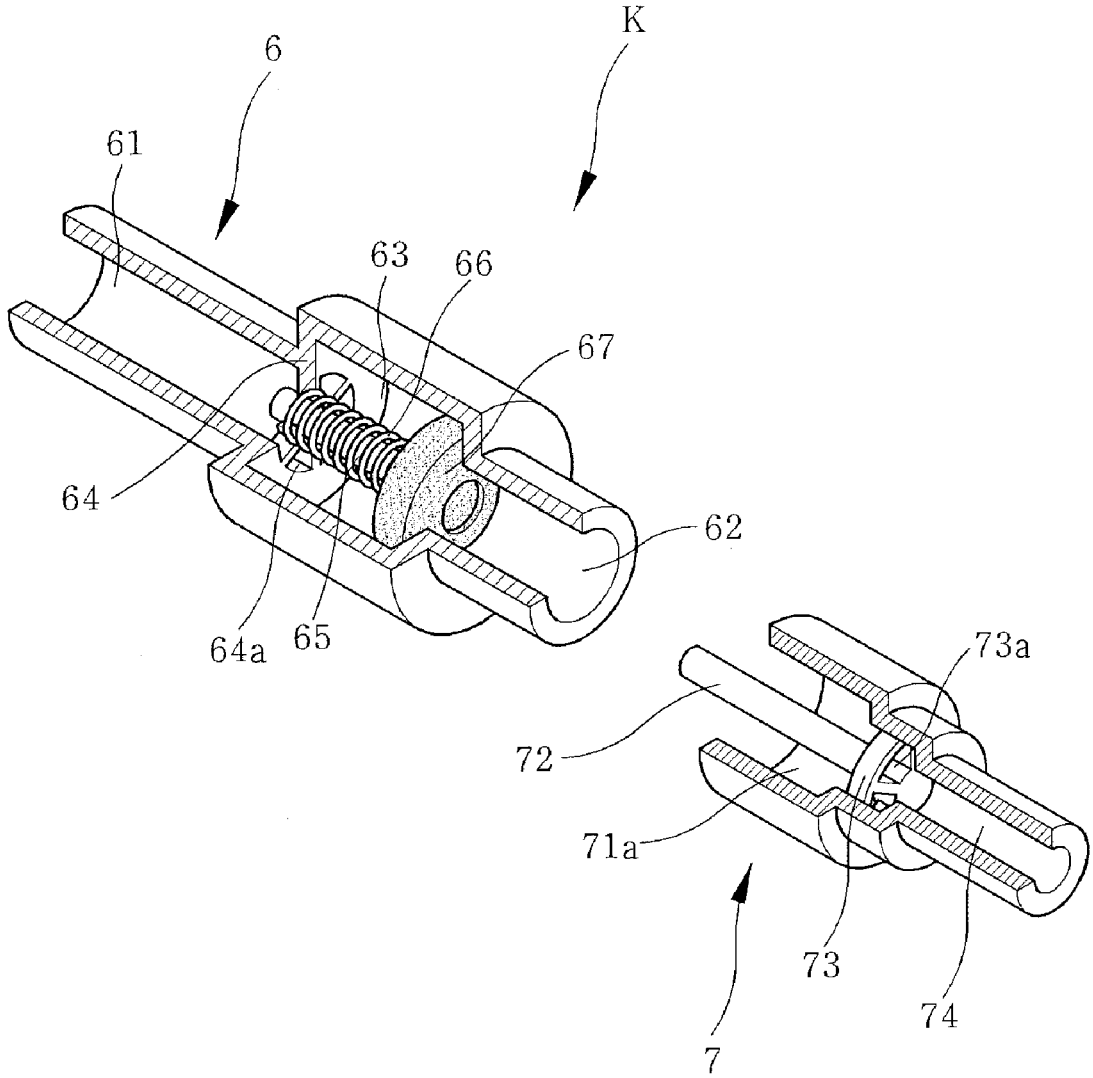
Figure 7:
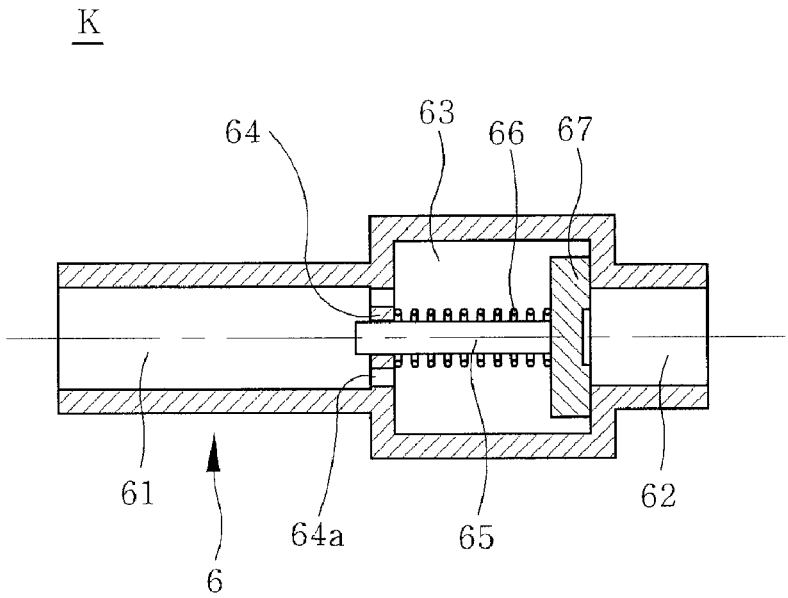
Figure 8:
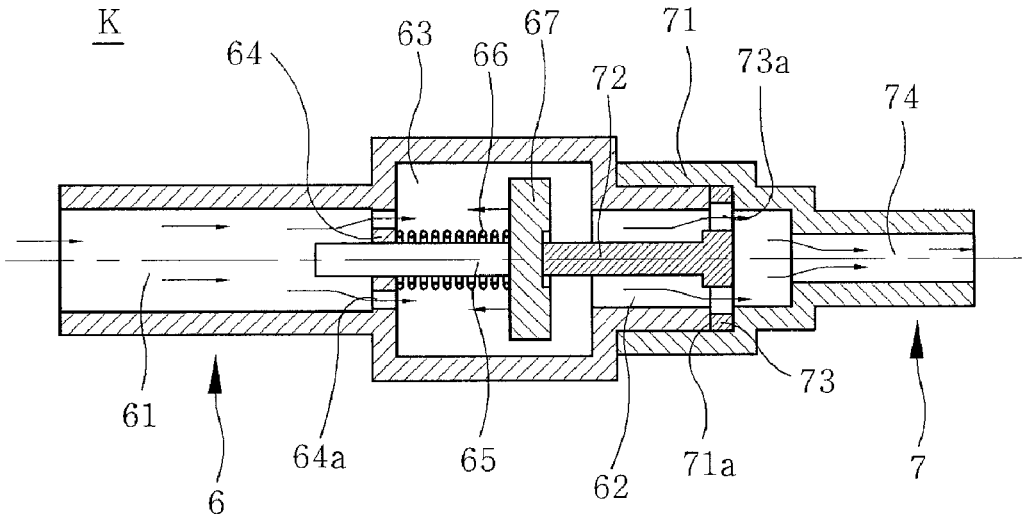

FIG. 6 is a perspective view illustrating the opening/closing unit for the steam discharge hole formed in the steam generator, and FIGS. 7 and 8 are sectional views illustrating the operation of the opening/closing unit shown in FIG. 6.

As shown in FIG. 6, the steam discharge hole opening/closing unit K of the present invention includes an opening/closing valve 6 fitted in the steam discharge hole 32 formed in the upright body 1 of the steam generator, and a connector 7 mounted to a corresponding structure of a cabinet 110 of a steam oven, to which the upright body 1 will be installed.

The opening/closing valve 6 includes an inlet channel 61 and an outlet channel 62 formed at both ends thereof, respectively, and a valve chamber 63 integrally formed with the inlet channel 61 and the outlet channel 62, the valve chamber 63 having a larger diameter than that of the inlet channel 61 and the outlet channel 62.

The opening/closing valve 6 further includes a shaft supporting portion 64 formed in the valve chamber 63 at the center of one end of the valve chamber 63, the shaft supporting portion 64 having an introduction passage 64*a* perforated therethrough, a slide shaft 65 having one end penetrated through the shaft supporting portion 64, and a valve body 67 formed at the other end of the slide shaft 65 and adapted to be elastically supported by a spring 66 in the closing direction of the outlet channel 62.

The connector 7 includes an inserting portion 71 having a receiving bore 71*a* to receive the outlet channel 62 of the valve 6, a press protrusion 72 supported by a supporting portion 73 and fixed in the center of the inserting portion 71, the supporting portion 73 having a discharge passage 73*a* perforated therethrough, and a communicating portion 74 integrally extending rearward from the inserting portion 71 to communicate the inserting portion 71 with the interior of the cooking chamber.

FIGS. 7 and 8 illustrate the operation of the steam discharge hole opening/closing unit. More particularly, FIG. 7 is a sectional view of the steam discharge hole opening/closing unit prior to being operated.

As shown, the steam discharge hole opening/closing unit K normally keeps a state wherein the outlet channel 62 of the opening/closing valve 6 is closed by the valve body 67 elastically supported by the spring 66.

Then, as shown in FIG. 8, if the outlet channel 62 of the opening/closing valve 6 is inserted into the inserting portion 71 of the connector 7 mounted to the cabinet, the valve body 67 of the opening/closing valve 6 is pushed backward, while overcoming the elastic force of the spring 66, by the press protrusion 72 integrally formed in the receiving bore 71*a* of the inserting portion 71, and the outlet channel 62 of the opening/closing valve 6 is opened. Thereby, the steam generated in the boiler compartment 3 can be introduced into the connector 7 by sequentially passing through the inlet channel 61, the introduction passage 64*a* of the shaft supporting portion 64, and the outlet channel 62 of the opening/closing valve 6. Subsequently, the introduced steam is delivered into the cooking chamber by sequentially passing through the receiving bore 71*a*, the discharge passage 73*a*, and the communicating portion 74 of the connector 7.

Figure 9:
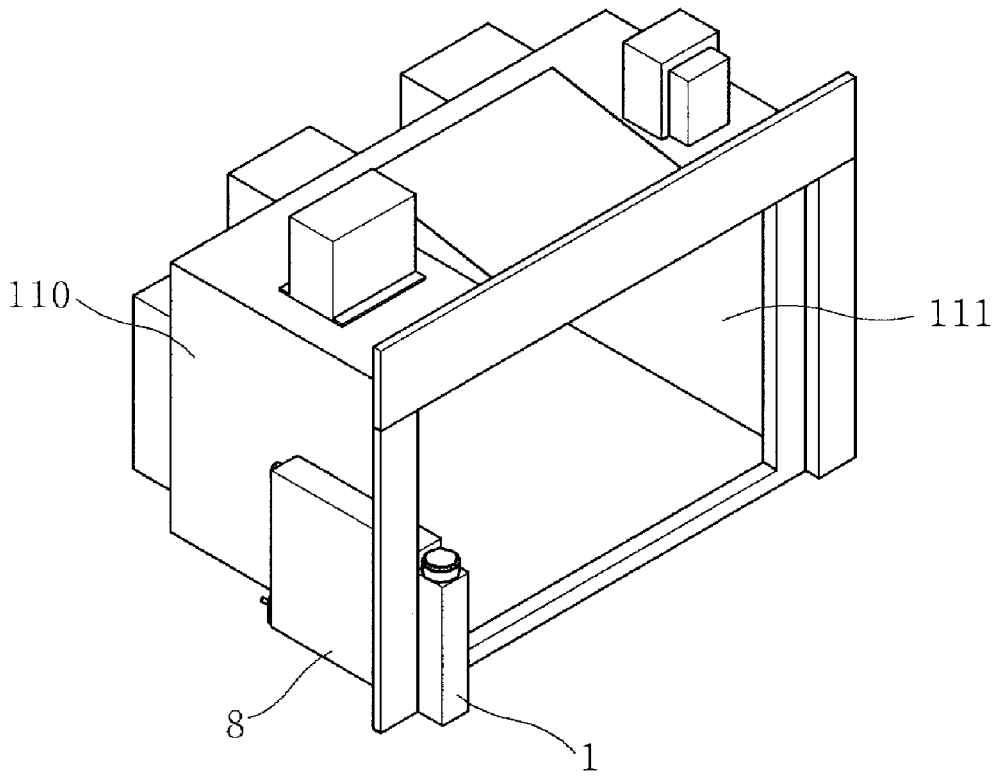
Figure 10:
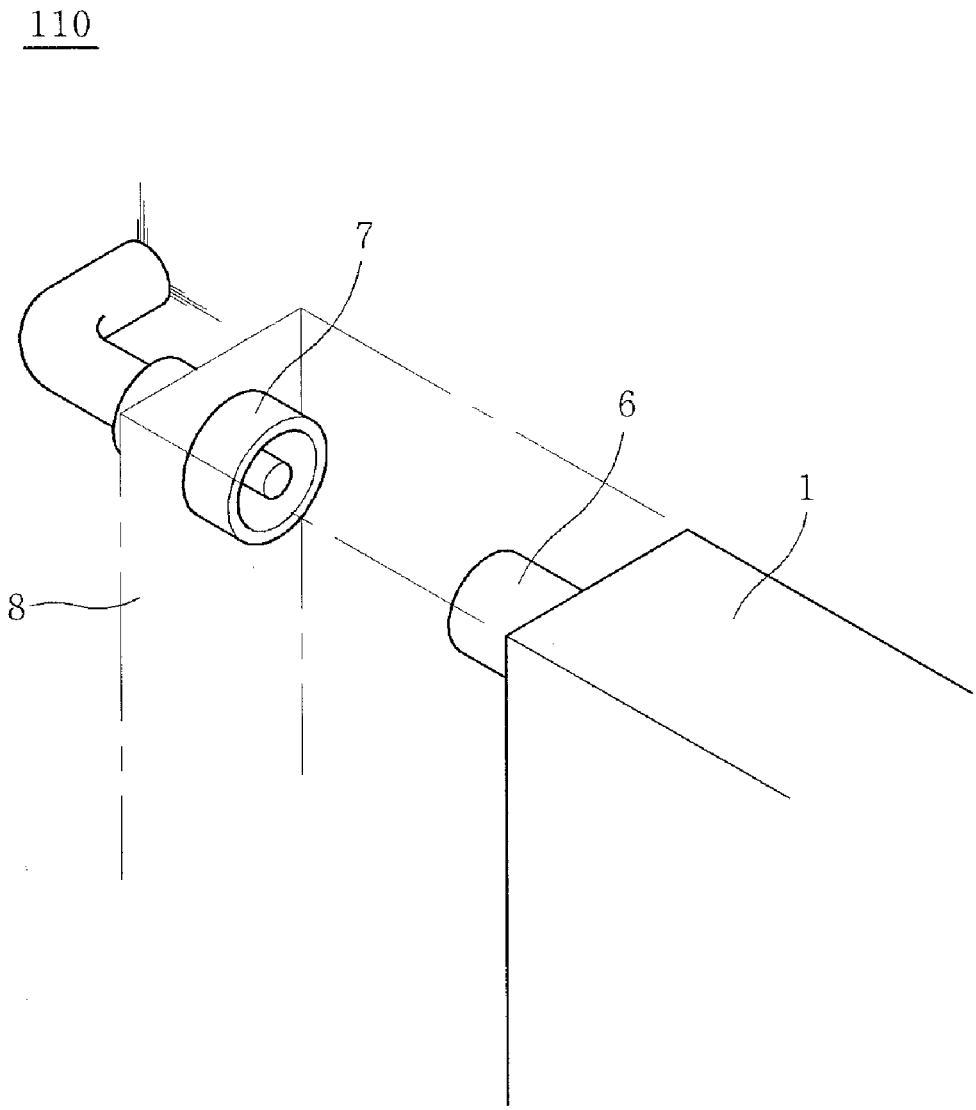

FIGS. 9 and 10 illustrate the steam generator mounted to the cabinet. More particularly, FIG. 9 is a perspective view illustrating the overall configuration of the cabinet, and FIG. 10 is a partially cut-away enlarged perspective view of a fixing bracket, which is used to install the steam generator to the cabinet.

As shown, to install the upright body 1 of the steam generator according to the present invention to the cabinet 110, a fixing bracket 8 is mounted to a side surface of the cabinet 110. The fixing bracket 8 has a rectangular box shape having an opened front side to correspond to the upright body 1 of the steam generator. The upright body 1 can be inserted into or separated from the fixing bracket 8 through the opened front side of the fixing bracket 8.

When the upright body 1 is inserted into the fixing bracket 8, as shown in FIG. 10, the opening/closing valve 6 of the upright body 1 and the connector 7 mounted to the fixing bracket 8 are coupled to each other, so as to communicate with each other as described above. When the upright body 1 is separated from the fixing bracket 8, the opening/closing valve 6 of the upright body 1 is automatically closed. In the present invention, the connector 7 mounted to the fixing bracket 8 takes the form of a tube and is installed to directly communicate with the cooking chamber defined in the cabinet 110. However, it will be appreciated that the connection relationship between the connector 7 and the cooking chamber is not limited thereto, and other connecting configurations can be considered so long as they do not hinder the function of the connector 7.

Figure 11:
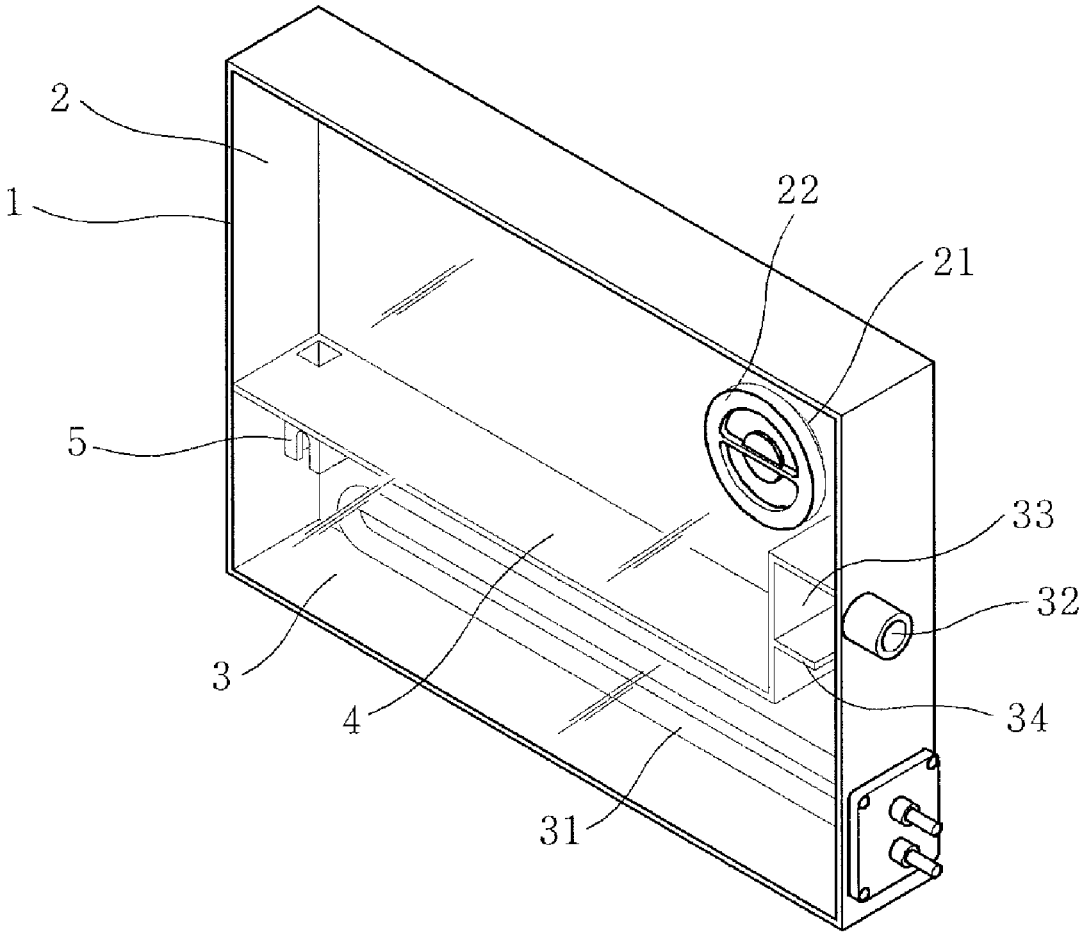
FIGS. 11 and 12 illustrate a steam generator according to a second embodiment of the present invention, FIG. 11 being a perspective view illustrating the overall configuration of the steam generator, and FIG. 12 being a longitudinal sectional view of FIG. 11.
Figure 12:
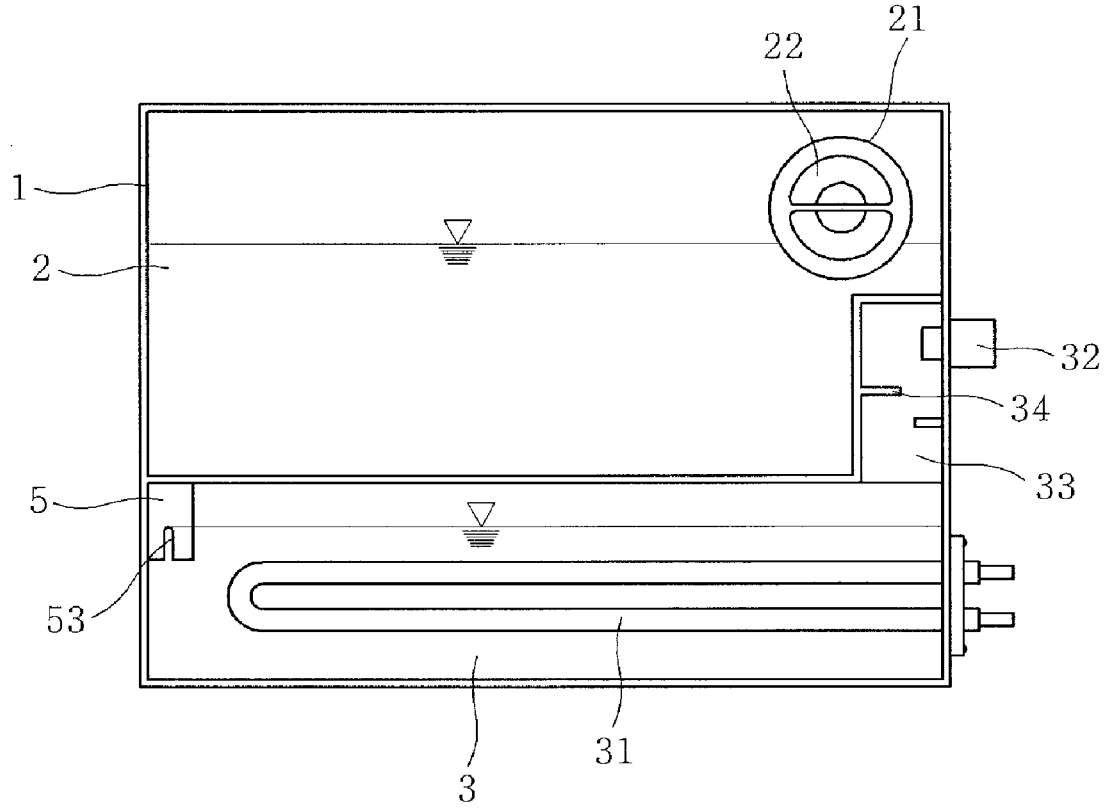

FIGS. 11 and 12 illustrate a steam generator according to a second embodiment of the present invention. More particularly, FIG. 11 is a perspective view illustrating the overall configuration of the steam generator, and FIG. 12 is a longitudinal sectional view of FIG. 11.

The most important difference between the present embodiment and the previously described first embodiment is positions of the water pouring hole 21 provided with the plug 22 and the steam discharge hole 32.

Differently from the first embodiment of the present invention in which the water pouring hole 21 is located at the opposite side of the steam discharge hole 32, in the second embodiment of the present invention, the water pouring hole 21 is located at the same side as the steam discharge hole 32. When providing the water pouring hole 21 at the opposite side of the steam discharge hole 32, water can be supplemented through the water pouring hole 21 without completely separating the upright body 1 of the steam generator from the fixing bracket 8 of the cabinet 110. On the other hand, when the water pouring hole 21 is located at the same side as the steam discharge hole 21, the supplement of water through the water pouring hole 21 is possible only when the upright body 1 is completely separated from the fixing bracket 8. The second embodiment of the present invention provides a full-separation type upright body of the steam generator (See FIGS. 9 and 10).

Also, differently from the first embodiment of the present invention in which the steam discharge hole 32 is located near the upper end of the upright body 1, in the second embodiment of the present invention, the steam discharge hole 32 is located at approximately the middle height of the upright body 1. This has an advantage of reducing a distance between the boiler compartment 3 and the steam passage 33 as much as the lowered height of the steam discharge hole 32.

When reducing the distance between the boiler compartment 3 and the steam passage 33, a time required for the steam generated in the boiler compartment 3 to reach the steam discharge hole 32 can be reduced. As a result, the present embodiment has an advantage of enabling a more rapid discharge of steam.

Figure 13:
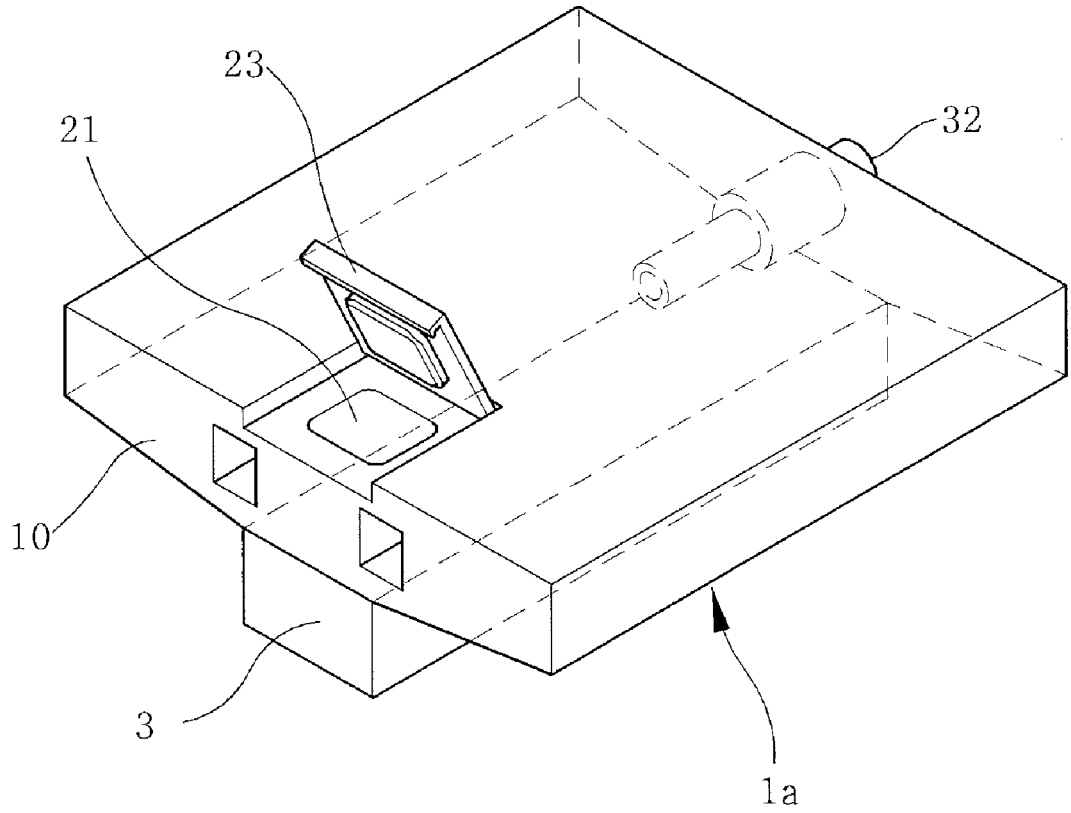
FIGS. 13 to 15 illustrate a steam generator according to a third embodiment of the present invention, FIG. 13 being a perspective view illustrating the overall configuration of the steam generator, FIG. 14 being a longitudinal sectional view of FIG. 13, and FIG. 15 being a perspective view illustrating the installed state of the steam generator.
Figure 14:
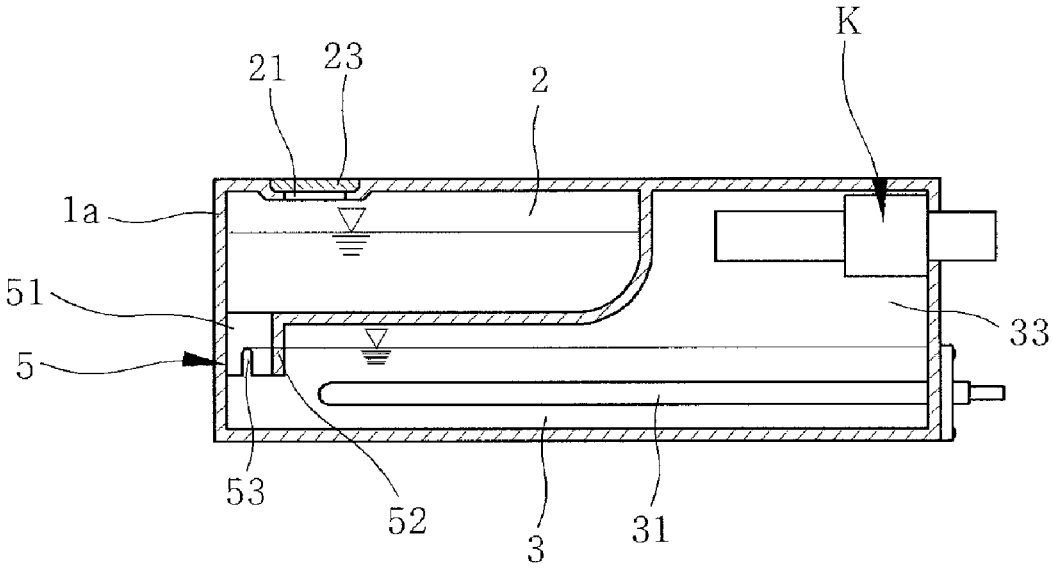
Figure 15:
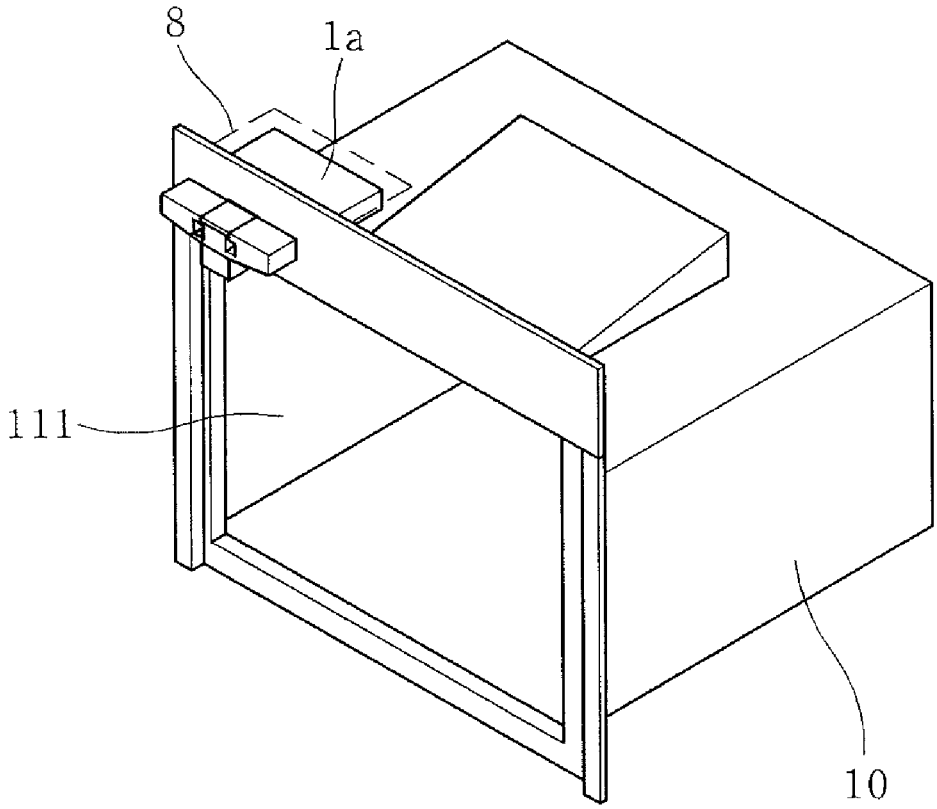

FIGS. 13 to 15 illustrate a steam generator according to a third embodiment of the present invention. More particularly, FIG. 13 is a perspective view illustrating the overall configuration of the steam generator, FIG. 14 is a longitudinal sectional view of FIG. 13, and FIG. 15 is a perspective view illustrating the steam generator installed on the top of the cabinet.

The present embodiment, as shown in FIG. 15, has a feature in that the steam generator is mounted on the top of the cabinet 110. In this case, the body of the steam generator is configured to be laid horizontally on the cabinet so as not to require a wide installation area therefor. In this case, the fixing bracket 8 is mounted on the top of the cabinet 110 to support and fix the body of the steam generator.

Similar to the above described first and second embodiments of the present invention, the technical principal of Torricelli's Experiment also can be applied to the steam generator according to the third embodiment of the present embodiment. For this, as shown in FIGS. 13 and 14, the steam generator of the third embodiment includes the water supply compartment 2 and the boiler compartment 3, which are divided into upper and lower regions by the partition 4, and the water-level adjusting hole 51 having the barrier wall 52 extending from the partition 4 into the boiler compartment 3 is provided between the water supply compartment 2 and the boiler compartment 3. The barrier wall 52 is formed with the slit 53, to determine the level of water in the boiler compartment 3 on the basis of the height of the slit 53.

The unique feature of the third embodiment according to the present invention is that the steam generator of the third embodiment includes a horizontal body 2 differently from the upright body 1 of the first and second embodiments. When providing the horizontal body 2, it should be noted that the water supply compartment 2, having the water pouring hole 21 and the plug 22, has a large capacity, and that a time required to generate steam in the boiler compartment 3 must be not so long.

For this, as shown in FIG. 13, the steam generator of the present embodiment is configured such that the water supply compartment 2 has a larger size than that of the boiler compartment 3, the boiler compartment 3 is located below the center of the water supply compartment 2 to assure the efficient supply of water from the water supply compartment 2 into the boiler compartment 3, and the water supply compartment 2 has an inclined bottom surface 10, which is inclined toward the boiler compartment 3.

The adjustment of the level of water in the boiler compartment 3 and the configurations and effects of other devices such as the steam discharge hole opening/closing unit K are identical to those of the first and second embodiments of the present invention, and thus, a detailed description thereof will be omitted to avoid the repetition of description.

As apparent from the above description, the present invention provides a steam generator of a steam oven having the following several effects.

Firstly, according to the present invention, elements required to generate steam, such as a water supply compartment, boiler compartment, water supply means, etc., constitute a single module, to provide the steam generator with a simplified configuration. This has the effects of achieving improved workability and reduced manufacturing costs of the resulting steam generator and also, of overcoming a limit in the inner volume of a cooking chamber of the steam oven.

Secondly, since the steam generator of the present invention can be detachably attached to a cabinet of the steam oven, it is possible to achieve the easy cleaning and washing of the steam generator, and consequently, to assure the sanitary use of the steam oven. Further, the steam generator is free from scale that is caused by precipitation of minerals contained in water, and can eliminate a deterioration in heating performance thereof.

Thirdly, due to the fact that the water supply compartment is separated from the boiler compartment, it is possible to heat only water in the boiler compartment. Further, cold water in the water supply compartment can be supplied into the boiler compartment by only a predetermined amount as much as a discharge amount of steam from the boiler compartment, without a risk of being mixed with hot water heated in the boiler compartment. This has the effect of significantly increasing the generation efficiency and rate of steam production.

Fourthly, according to the present invention, a steam discharge hole formed in the steam generator can be automatically opened or closed in the course that the steam generator is attached to or detached from the cabinet. This has an advantage of increasing the use convenience of the steam generator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A steam generator of a steam oven to cook food received in a cooking chamber by use of steam generated by the steam generator, wherein the steam generator comprises a single body having an inner space divided into a water supply compartment and a boiler compartment by a partition, the water supply compartment having a water pouring hole, and the boiler compartment having a heater and a steam discharge hole, wherein a water supply passage is defined between the water supply compartment and the boiler compartment, wherein the body takes the form of an upright body having the water supply compartment and the boiler compartment divided, as upper and lower compartments, by the partition, and wherein the upright body includes a steam discharge hole opening/closing unit to allow the steam discharge hole to be opened only by an external pressure.

2. The steam generator according to claim 1, wherein the water pouring hole and the steam discharge hole are located at one side and the other side of the upper part of the upright body, and wherein a steam passage is defined between the steam discharge hole and the boiler compartment.

3. The steam generator according to claim 1, wherein the water supply passage is defined by a water-level adjusting hole having a barrier wall extending from the partition into the boiler compartment.

4. The steam generator according to claim 3, wherein the barrier wall has a bottom-opened slit.

5. The steam generator according to claim 2, wherein a plurality of water-splash-proof partitions are arranged alternately at both sidewalls of the steam passage to face each other.

6. The steam generator according to claim 5, wherein each water-splash-proof partition has a downwardly-inclined surface.

7. The steam generator according to claim 1, wherein the steam discharge hole opening/closing unit includes an opening/closing valve, and wherein the opening/closing valve includes:

an inlet channel and an outlet channel formed at both ends of the opening/closing valve, respectively;

a valve chamber integrally formed with the inlet channel and the outlet channel and having a larger diameter than a diameter of the inlet channel or the outlet channel;

a shaft supporting portion formed in the valve chamber at the center of one end of the valve chamber, the shaft supporting portion having an introduction passage perforated therethrough;

a slide shaft slidably supported by the shaft supporting portion;

a spring provided on an outer circumference of the slide shaft; and a valve body elastically supported by the spring to be pushed in a direction of closing the outlet channel.

8. The steam generator according to claim 7, wherein the steam discharge hole opening/closing unit further includes a connector, and wherein the connector includes:

an inserting portion having a receiving bore to receive the outlet channel of the valve;

a supporting portion having a discharge passage;

a press protrusion supported by the supporting portion and fixed in the center of the inserting portion; and a communicating portion integrally extending from the inserting portion to communicate the inserting portion and the interior of the cooking chamber with each other.

9. The steam generator according to claim 1, wherein the body takes the form of a horizontally laid body having the water supply compartment and the boiler compartment divided, as upper and lower compartments, by the partition.

10. The steam generator according to claim 9, wherein the water supply compartment further has a pair of symmetrically inclined bottom surfaces extending from both ends thereof and spaced apart from each other by a predetermined distance, and the boiler compartment has a width corresponding to the distance between the inclined bottom surfaces.

* * * * *